US005588653A

United States Patent [19]

Robinson

[11] Patent Number: 5,588,653

[45] Date of Patent: Dec. 31, 1996

[54] GOLF SWING PRACTICE DEVICE

[76] Inventor: Gary G. Robinson, R. R. #4, Komoka, Ontario, Canada, N0L 1R0

[21] Appl. No.: 543,893

[22] Filed: Oct. 17, 1995

[30] Foreign Application Priority Data

Oct. 6, 1995 [CA] Canada ..... 2160059

[51] Int. Cl.[6] ..... A63B 69/36

[52] U.S. Cl. ..... 473/218; 473/270

[58] Field of Search ..... 273/186.1, 187 R, 273/191 R, 191 A, 191 B, 192 R, 32 B, 162 R, 163 A, 194 R, 194 A, 194 B; 434/252

[56] References Cited

U.S. PATENT DOCUMENTS

| | | | |
|---|---|---|---|
| D. 239,726 | 4/1976 | Wintering | D21/2 |
| 3,565,444 | 2/1971 | La Rocca | 273/186.2 |
| 3,610,632 | 10/1971 | Caldwell | 273/187 R |
| 3,615,095 | 10/1971 | Lafontaine | 273/187 R |
| 3,638,950 | 2/1972 | Hyotlaine | 273/187 R |
| 4,322,084 | 3/1982 | Reece et al. | 273/187 R |
| 4,354,683 | 10/1982 | Woolland | 273/187 R |
| 4,583,739 | 4/1986 | Kabbany | 273/187 R |
| 5,288,073 | 2/1994 | Noel | 273/191 R X |
| 5,362,060 | 11/1994 | Hinson | 273/187 R |
| 5,415,406 | 5/1995 | Reichenbach et al. | 273/186.2 |

FOREIGN PATENT DOCUMENTS

| | | |
|---|---|---|
| 2123322 | 4/1994 | Canada . |
| W094/07576 | 4/1994 | WIPO . |

*Primary Examiner*—George J. Marlo
*Attorney, Agent, or Firm*—Charles P. Boukus, Jr.

[57] ABSTRACT

Disclosed is a device for use with golf clubs in order to provide an assembly of clubs on the ground to assist a golfer in practicing his/her golf stance and swing. The device is of plastic material and includes a plate with one or more clip-like connector elements on each face of the plate whereby two clubs may be secured at least in a cross-like formation. Additional clip-like connector elements on the faces of the plate enable two of the devices to be used whereby three and four clubs can be assembled in selected formation to provide a grid on the ground for visual assistance not only on the stance of the golfer, but also in the position of the club being swung at the major checkpoints in the swing. The devices are easily carried by the golfer in his/her bag and can be used with clubs in the bag to assist in practicing the stance and swing.

22 Claims, 10 Drawing Sheets

GOLF SWING PRACTICE DEVICE

The invention relates to a device to assist golfers in developing a proper stance in practicing swings and aligning shots with the intended direction.

BACKGROUND OF THE INVENTION

Golf has been a popular sport for many years but the development of golf and the number of participants has increased tremendously in the last 20 years. One need only recall the significant increase in golf course construction that has taken place over the last 20 years, to confirm that golf is one of the fastest growing recreational sports activities. Golf is also a widely watched sports event, particularly on television.

One of the perennial problems of all golfers, even so called "good golfers", is choosing a proper stance relative to the intended or desired direction of flight of the golf ball. Golfers have often placed a club on the ground aligned with the desired direction of flight of the ball and then chosen a stance wherein their feet are substantially square to the line defined by the club which is parallel to the intended flight of the ball. However, the additional alignment of the ball and club in relation to the feet is still left open to the perception of the player.

Golfing aids to assist golfers in selecting an appropriate stance when "lining" up a golf shot are well known in the art. For example, U.S. Pat. No. 4,583,739 granted Apr. 22, 1986 to Kabbany relates to a goffer's stance position device which comprises a pair of elongated members pivotably secured to one another and pivotable between an operable position wherein the members are substantially at right angles and a closed, collapsed or inoperable party.

The device is not easily transportable by the golfer and is the type of device that relatively takes up additional space. No golfer would carry it with him/her and it is the type of device, while collapsible, is still of a size left mainly to practice areas.

U.S. Pat. No. 3,610,632 granted Oct. 5, 1971 relates to a golfing aid which provides a directional aid in practicing golf shots. The device comprises two guides adjustably connectable at right angles to one another and the device includes a third guide member pivoted to the end of one of the other two. The two guides are seated in a slotted connector member to which a cap is threadedly secured to hold the guides in their right angular relationship. The cap includes a spigot to hold the two crossed guides firmly together.

It would be advantageous for a golfer to have a simple, easily portable device which would hold two golf clubs from his/her bag not otherwise being used, at right angles. The assembly can be placed on the ground and used to provide directional aid to the practicing golfer with respect to his feet, body and the ball with regard to the intended line of flight of the ball.

The assembly or grid-like form useful in developing improved stance techniques with respect to the intended flight of a ball. Further, the assembly would assist developing consistency with respect to the position of the feet in relation to the ball and the position of the body relative to the ball to be hit.

While the prior art shows more complicated devices and indicia marked guides as noted above, the fact that the clubs of the golfer can be used would be a significant attraction to the frequency of use of this device assembled with clubs, since the device can be used at any time wherever the golfer is with his/her clubs and golf bag and particularly on a practice range.

Further, golfer's need to develop consistency and repetition in a swing and it would be advantageous for the golfer to not only have a grid for his/her stance but also to have a device or devices which, when assembled with golf clubs, will enable the golfer to further visualize the position of a club in relation to the hands, arms and body and be able to repeat the swing so the "feel" of these positions develops into a consistent golf swing. Two of the more preferred devices when assembled with these clubs enables the golfer to visualize the "clock" technique of David Leadbetter, one of the leading golf teachers, a teaching which provides check points in the swing.

SUMMARY OF THE INVENTION

Accordingly, the invention in one aspect seeks to provide a device which will permit two golf clubs to be detachably secured in a cross configuration at 90° to each other, which assembly may be placed on the ground and used by the golfer in practice sessions to improve his/her address to the ball and in particular, the placement of the feet in relation to the intended or desired direction of the ball.

More particularly, in one embodiment of the device, there is a plate portion and clip-like connectors on each face of the plate for detachable connection with the shafts of golf clubs, preferably adjacent the grip of the clubs. These first and second clip-like connectors on opposed faces of the plate portion are oriented at 90° to each other whereby clubs assembled with the device are at right angles to each other.

In another, more preferred aspect, the device includes an additional clip-like connector on each face of the plate which will permit the use of the two such devices to form a grid assembly of clubs which will provide visual help in appreciating the position of the check points in the development of a golf swing. One of the additional, third, clip-like connectors is parallel to and on the same face as the first connector whereas the other, additional clip-like connector, the fourth, is on the same side of the plate as the second connector but at a selected angle to the axis of the first and third connectors.

Preferably, the device is made of plastic and the clip-like connectors are sized to take into consideration the normal taper aspects of golf clubs. Although one elongate clip-like connector may be on each side, I prefer to have two spaced but aligned clip-like connectors on each face of the plate portion. The clip-like connectors may be U-shaped with the opening of the clip either outwardly or in the direction of the plane of the respective plate face. The clip-like connectors have an opening which is narrower than a generally cylindrical bore and the legs of the clip are flexible enough that the shaft of a club may be snap fitted into the clip. In one aspect of the invention, the device is connected with the club shaft at a portion of the club shaft nearer the club head and then moved relatively to that club shaft to be located adjacent the grip portion of the club. In another more preferred embodiment, one of the clips is designed to secure to the shaft of a club distant from the grip thereof.

The inventive device is preferably of plastic material, is relatively inexpensive and is durable and easily carried by the golfer in his/her bag so that it is always available for use when on a practice tee or the like. The device, whether used singly or used with other like devices, when assembled with clubs, will maintain such clubs in the proper orientation so that the assembly, once on the ground, can be moved or repositioned with ease by a foot or another club without losing the relative orientation of the clubs in the assembly.

The invention will be further understood and appreciated from the description of a preferred embodiment in conjunction with the drawings presented herein.

Figure 1:
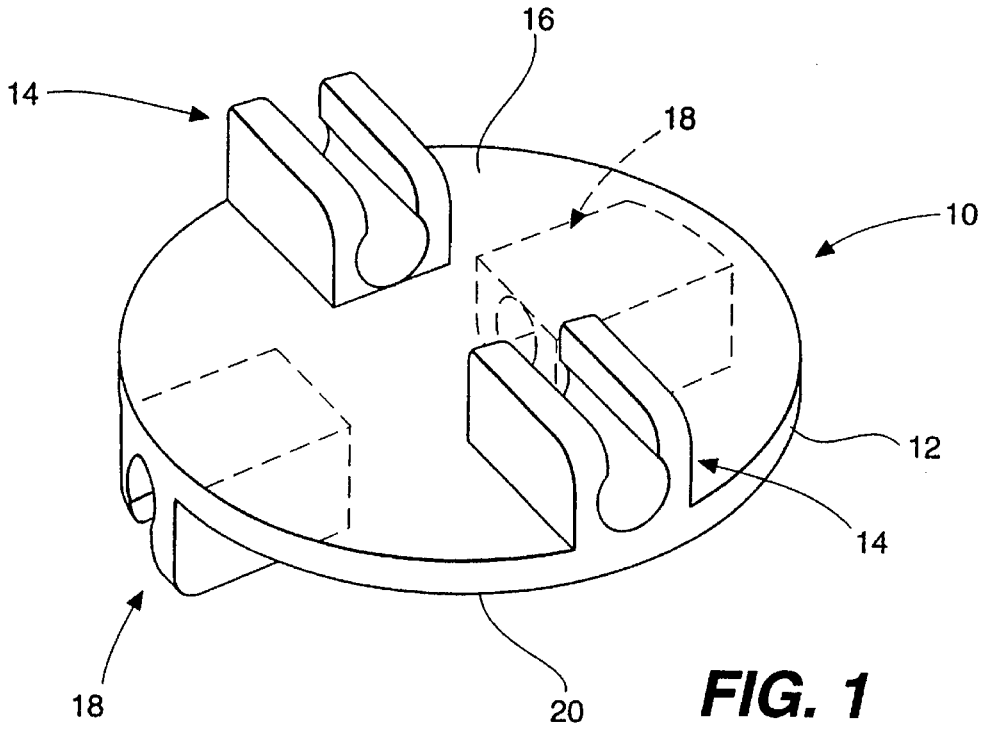
FIG. 1 is a perspective view of an embodiment of the inventive device.
Figure 2:
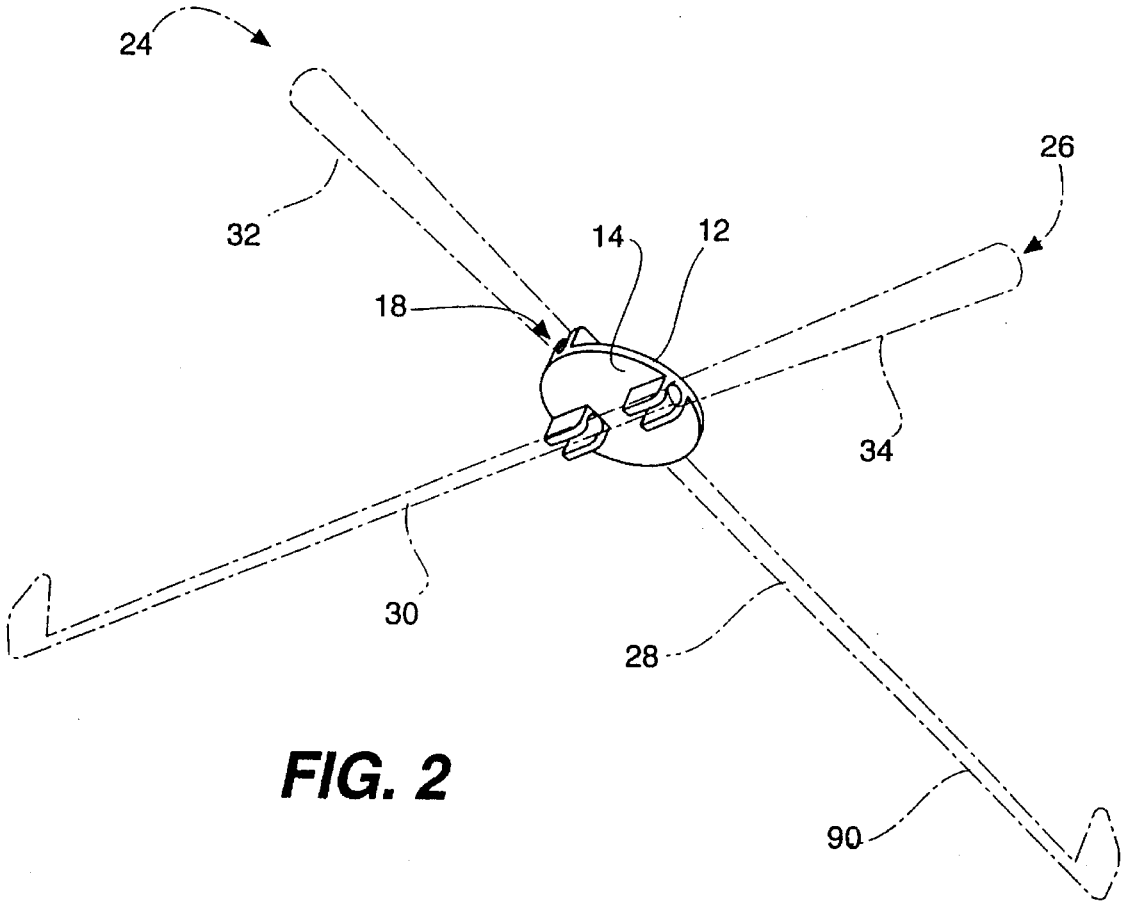
FIG. 2 is a perspective view showing the device of FIG. 1 in assembly with two golf clubs.

FIGS. *7a*, *7b* are views from the side and front respectively of a golfer using the assembly of FIG. 2.

Figure 8:
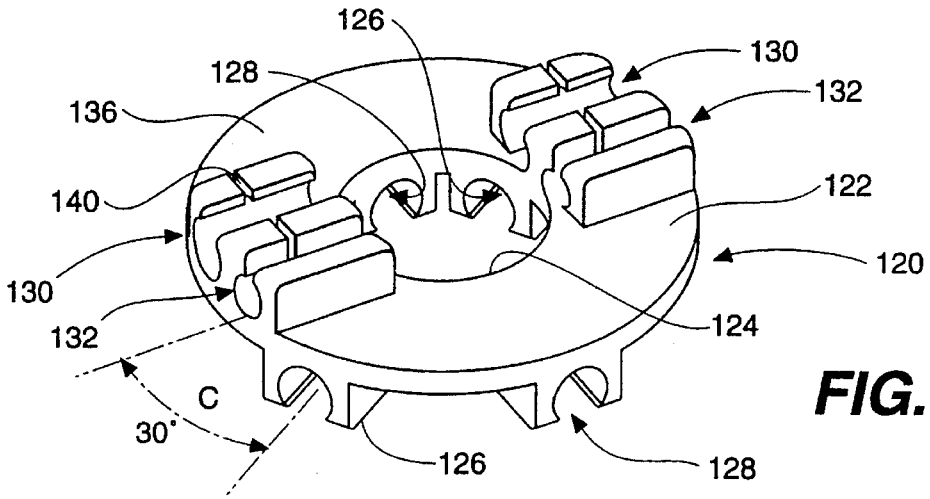

FIG. 8 is a perspective view of a particularly preferred embodiment of the inventive device.

Figure 9:
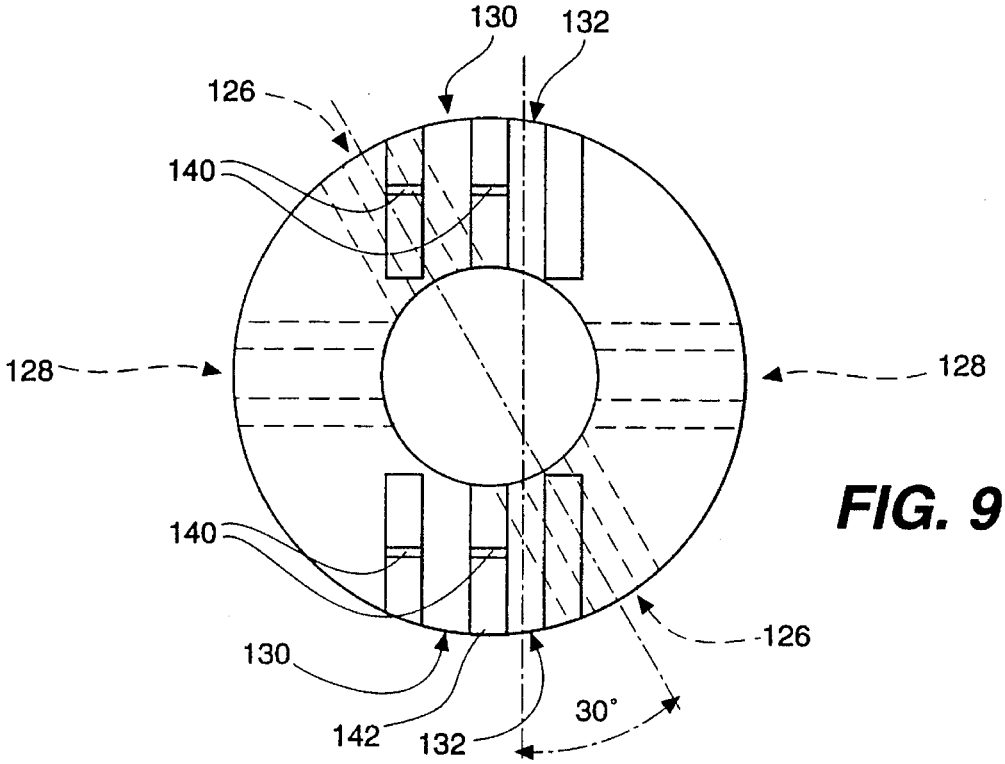

FIG. 9 is a top view of the device of FIG. 8.

Figure 10:
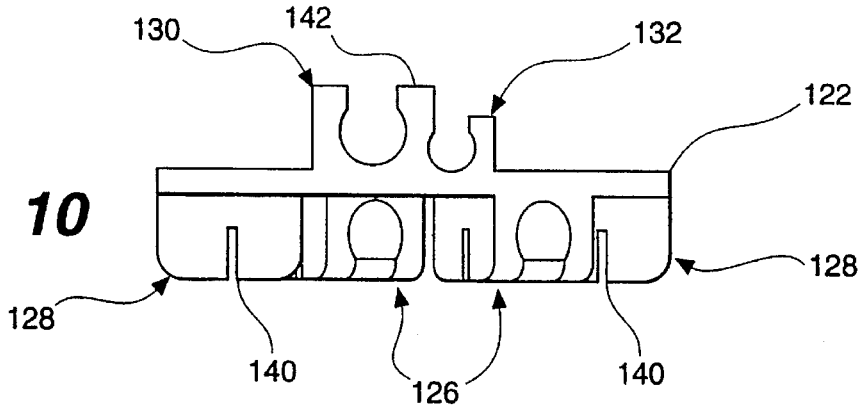

FIG. 10 is a front elevational view of the device as shown in FIG. 9.

FIGS. 11, 12, 13 and 14, each with parts a, b, c, show a golfer using two devices in assembly with three golf clubs, from address of a golf ball and three links to the swing, part (a) showing the golfer in front view, part (b) showing the golfer in side view and part (c) showing the club assembly schematically from above with the practice club shown in phantom lines.

Figure 15:
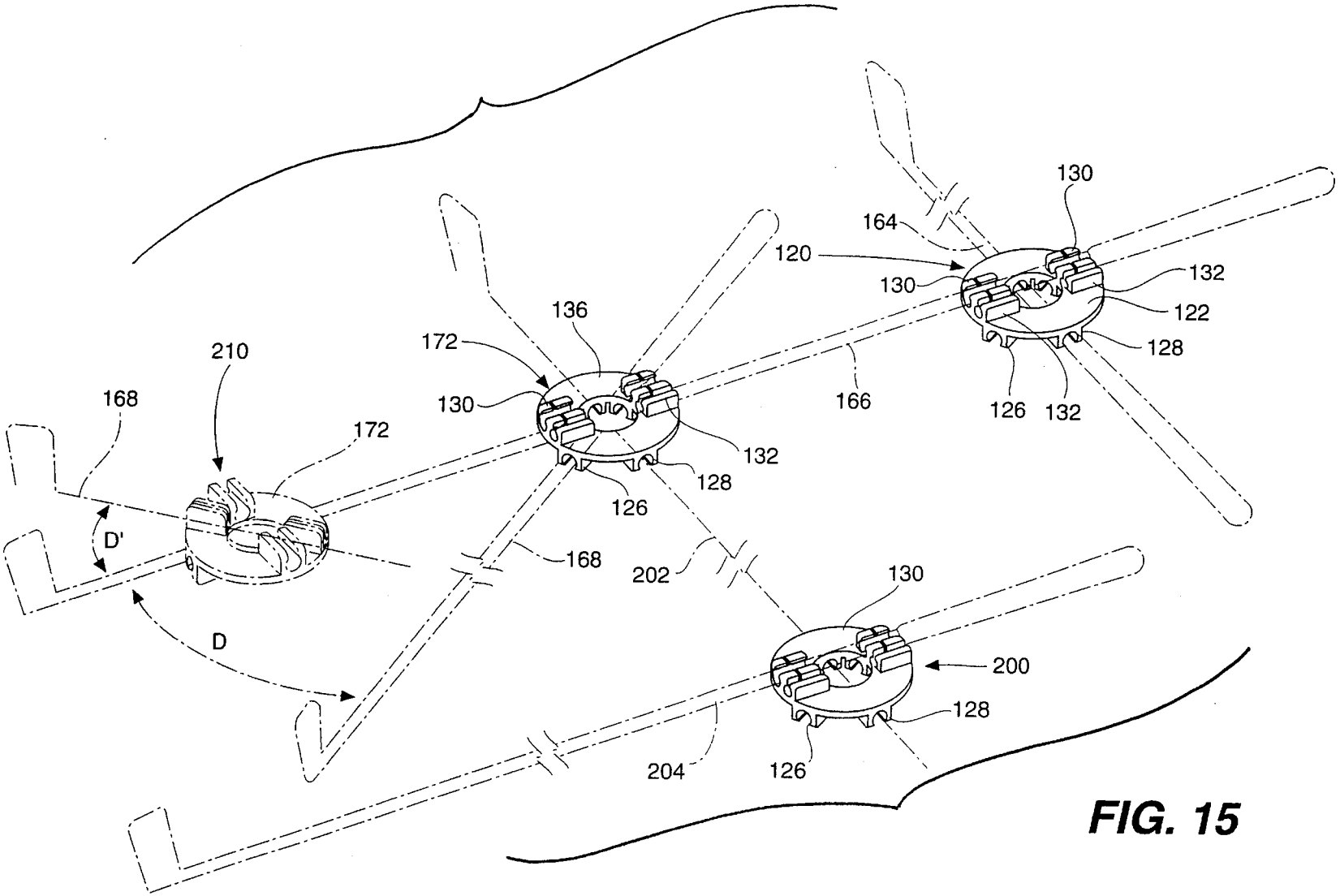

FIG. 15 is an enlarged view partly of the various assemblies of clubs with devices of the invention and illustrates a still further arrangement of devices/clubs, namely using three of the inventive devices assembled with clubs to further help in alignment of the feet with the flight of the ball.

Figure 16:
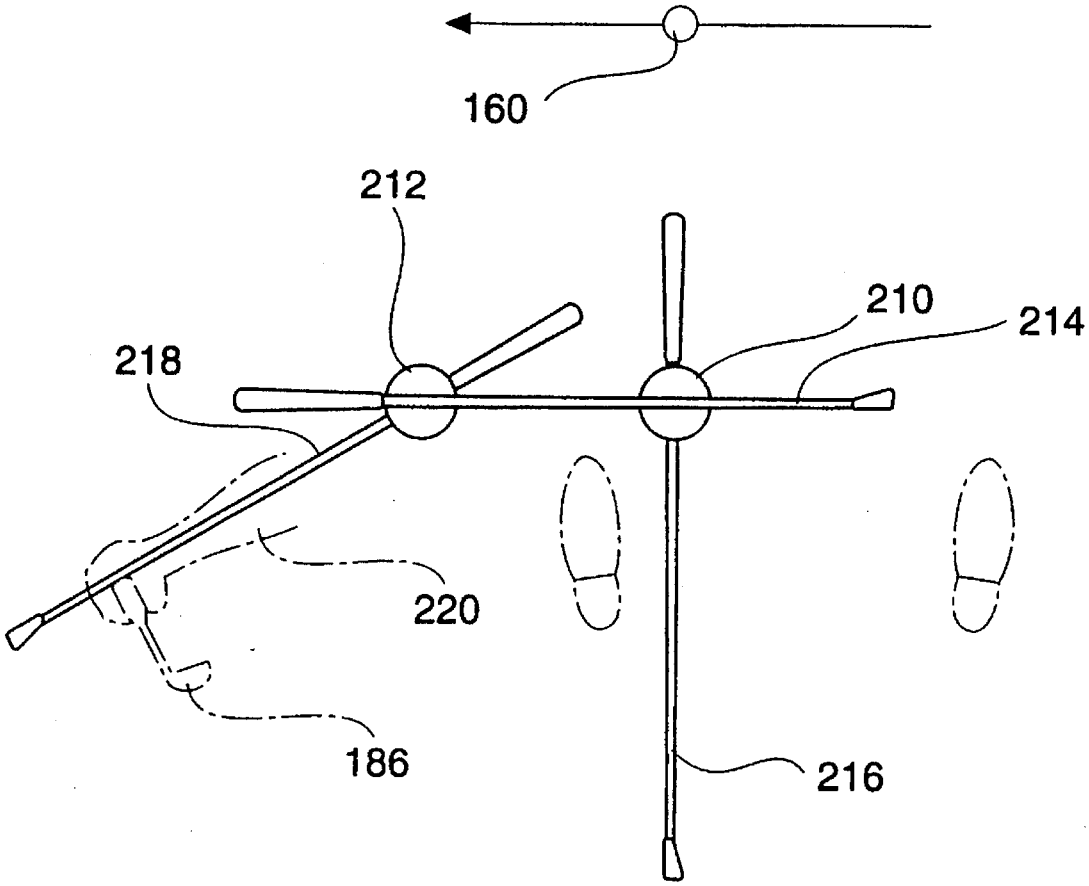

FIG. 16 illustrates a golfer using two devices to assist in practicing the follow through of a golf swing.

DESCRIPTION OF PREFERRED EMBODIMENTS OF THE INVENTION

Turning to FIGS. 1, 2, 3 and 4, the device 10 comprises a circular plate 12 having a golf club shaft connector means 14 extending from face 16 and an identical golf club shaft connector means 18 extending from opposite face 20 such that connector means 18 is at 90° right angles to connector means 14. Connector means 14 and 18 are adapted to detachably hold two golf clubs 24 and 26 at right angles or in a cross configuration, (as shown in FIG. 2), with the connector means 14 and 18 detachably secured respectively, to the shafts 28, 30 adjacent the respective grips 32 and 34.

Connector means 14 and 18 are identical in construction so that only connector means 14 will be referred to in detail, with like parts also referring to connector means 18.

Connector means 14 comprises clips 40 and 42 which are substantially identical in construction, each clip 40 and 42 having side walls 44 and 46 extending outwardly from face 16, (or face 20), with the outer edges 48, 50 thereof defining inwardly directed flanges 52 and 54 respectively. Flanges 52 and 54 define gap or slot 60 therebetween. The respective inner support faces 62 and 64 of side wails 44 and 46 are concave and define a cylindrical bore 66 which will accommodate the shaft 30 of a golf club 26 adjacent the grip 34 thereof. Clips 40, 42 are generally U-shaped in configuration, part of the U-shape including the surface of plate 16 between walls 44 and 46.

Since the shafts of golf clubs are tapered, the internal diameter of bore 66 of clip 40 and that of clip 42 are slightly different, the diameter of bore 66 of clip 40 being slightly less than that of clip 42, the latter being the one closest to the grip 34. It will be appreciated that the bore diameter of clips 40, 42 could be tapered, in which case the connector means could be continuous across the width of face 16 of plate 12. The aligned space 68 between clips 40 and 42, permits each clip to have a separate bore diameter continuous throughout its length but varied slightly from the other to more closely match the respective diameter of the tapered shape of the golf shaft where the clips 40, 42 are located when the device is adjacent the grip of the club.

Figure 5:
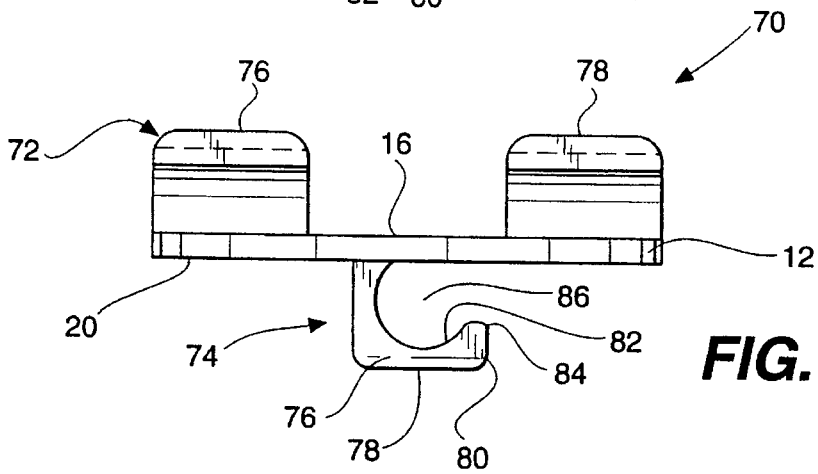
FIG. 5 is a front elevational view of a modification of the device.

FIG. 5 illustrates a modified device 70 comprising plate 12 with faces 16 and 20 and connector means 72, 74, each connector means 72, 74 being identical and generally L-shaped in configuration but forming a U-shaped connector in conjunction with the adjacent face of the plate.

Considering connector means 72, 74, they are each comprised of clips 76, 78 with each clip 76, 78 having outer edge 80 of wall segment 82 defining a flange 84. Bore 86, between wall 82 and face 20, is adapted to accommodate the shaft of a golf club adjacent the grip portion thereof. Clips 76, 78 are sufficiently flexible to permit a shaft to be slid into or snap fitted into bore 86.

Again, in the modified embodiment of FIG. 5, the diameters of the bore 86 of clips 76 and 78 are varied slightly to take into consideration the taper of the golf shaft. Further, it will be apparent to persons skilled in the art that connector means 72 and 74 could be made continuous over the width of plate 20, in which case a longitudinally tapered bore would be preferred in order to take into consideration the taper of a golf shaft, even those shafts which are tapered in steps.

Alternatively, there could be any number of clip sections. For example, clips 76 and 78 could each be split into two clips for a total of four short clips per side, of plate 12, but in any event, the object being to provide a sample connector system which will easily and securely connect with the tapered shaft of a golf club, preferably adjacent the grip portion thereof.

Figure 6:
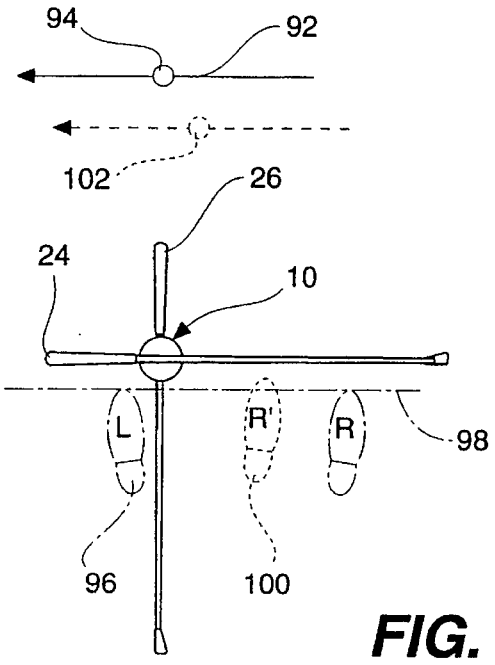
FIG. 6 is a view of the device in assembly as shown in FIG. 2 on the ground with a schematic illustration of the feet of a golfer.

Returning to FIG. 2, it will be appreciated that the diameter of the lower portion 90 of club 24 is smaller than that adjacent the grip 32, so that in assembling a club to the device, the smaller portion 90 of the shaft can be inserted through gap 60 into the bore 66 of the connector means 18 and the shaft and device slid relative to each other to locate the device so that the grip 32 of the club is adjacent the device 10, as shown in FIG. 2. It is preferred to assemble device 10 so that it is adjacent the grips of the club since the grips of all golf clubs are substantially the same length, thereby providing a uniform assembly regardless of which clubs are used. However, it will be appreciated that assembling a device 10 so that it is located at some other location on the shaft is possible with the appropriate modifications in the sizing of the bore and flexibility of the clips of the connector means during manufacture. Once the clubs are secured, the assembly is quite sturdy. The assembly may be placed on the ground and moved by a foot or another club so that the shaft of one club is aligned in the desired direction of flight of the ball. The club shaft which is perpendicular or at 90° to the club defining the intended or desired direction of flight, provides a grid-like demarcation for further locating the feet of the golfer in relation to the club being used and in locating the placement of the ball. More particularly, turning to FIGS. 6 to 7*b*, FIG. 6 illustrates the device on the ground with arrow 92 showing the desired and intended flight of a ball 94. Club 24 is aligned parallel with the direction defined by arrow 92 and club 26 is automatically located at 90° thereto, the assembly thereby defining in essence a grid to help the golfer choose his/her stance. For a driver, by way of example, the ball 94 is preferably located just inside the left heel 96 with the right foot located on a line, (dot-dash line 98), generally parallel to club 24 (and the intended direction 92 of ball flight). Depending on the golfer, the toes of the feet can be placed closer to club 24. Alternatively and by way of further example, the right foot can be moved relative to the club 24 such as shown in dotted lines 100 and the ball located at 102 for say, a mid-iron, (5–7), shot. In any event, the assembly helps define a grid which can be used to assist the golfer to build consistency into his/her stance and swing.

Figure 7A:
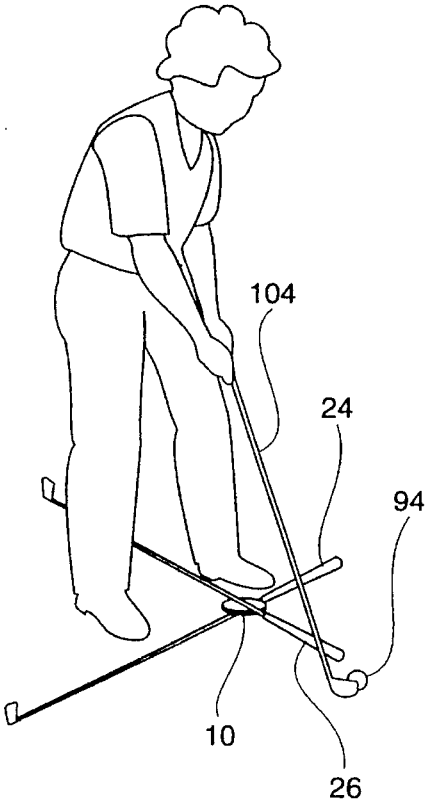
Figure 7B:
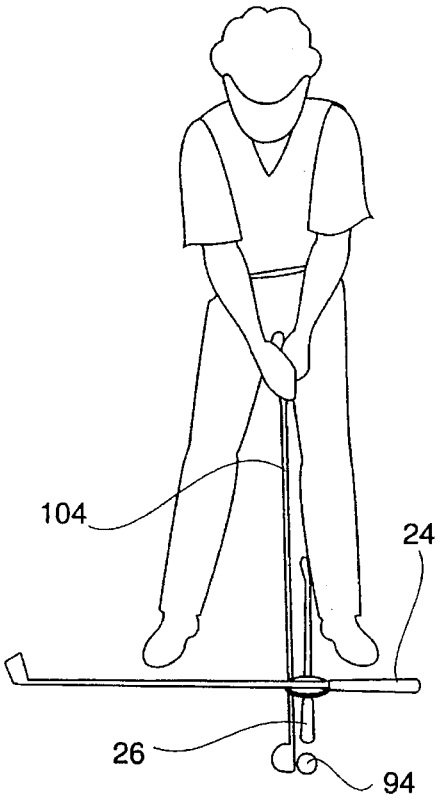

FIGS. 7*a* and 7*b* show a golfer addressing the ball and using the device 10 with a driver 104. Particularly from FIG. 7*b*, it will be noted how the club and hands are aligned with the direction of club 26 in conjunction with the left foot and the ball. The golfer, when addressing the ball 94, has a grid-like perspective which allows him/her to associate the correct or preferred location of the feet, hands, arms and shoulders with respect to the desired direction of the shot.

Figure 3:
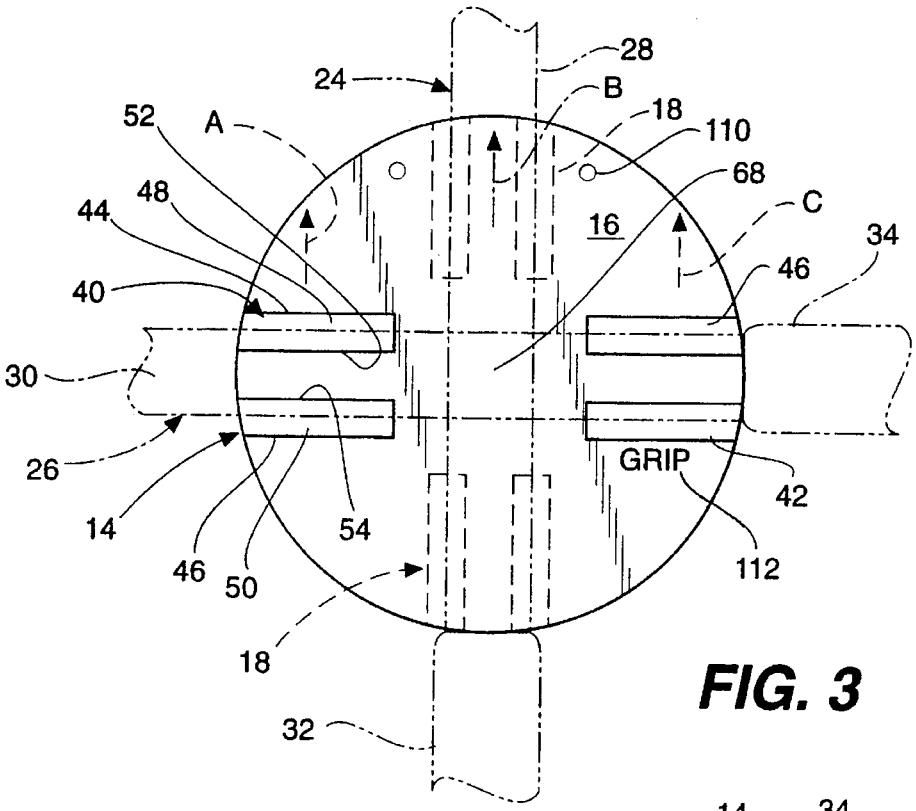
FIG. 3 is a top view of the device of FIG. 1 with parts of the club shafts shown in phantom lines.

Device 10 is simple to make and can preferably be integrally molded of plastic material which does not rust, will last for a long time and is free of sharp edges or corners and therefore will not damage a golf bag, whether carried in a pocket or suspended from a chain (not shown) through an appropriate aperture 110, (FIG. 3). The flexibility of plastic also enhances the ability to have a detachably secure connection with golf clubs. The device will always be with the golfer and in being designed for use with clubs in his/her bag, it is very convenient for use at any time when practicing, particularly on a golf range. The assembled device, as noted before, can be easily moved when on the ground to select different directions and to align the assembly to select divetless portions of the practice area. The clubs are firmly held at 90° and the location of the clubs on the ground is such that they will not interfere with the golfer while hitting balls. Use of the device helps the golfer in selecting his/her stance in relation to the intended direction of flight of a ball and to associate the feet, hands, arms and hips with such stance and alignment.

As previously noted, connector means 14 and 18 could each be molded as one longitudinal section. However, it is preferred to have at least two clips 42, 44 in view of the tapering construction of golf club shafts, the variation in the diameter of the bores of clips 42, 44 providing for a more secure assembly between device and club. In such case, some marking, such as the word "GRIP" shown at 112 in FIG. 3, can be used to indicate that clip 44, for example, is the one to locate adjacent the grip of a club in assembling the clubs to the device.

Further as shown in FIG. 3, arrows may be placed on a preferred upper surface of plate 12 to indicate where the ball can be placed in relation to the line of the club 28 and the left foot. For example, arrow A could be for "drivers" arrow B for fairway shots and arrow C for low irons "knock down" shots or draw shots. Advertising material or the name of a golf course can also be imprinted or decaled on the device without difficulty. Still further, plate portion 12 could have additional apertures to carry a plurality of golf tees and/or golf markers.

Dimensions of the device can vary as well as the length and flexibility of the connector means but a plate about 3½ inches in diameter has been found satisfactory. Further, plate 12 need not be circular, but other shapes such as rectangular or triangular are contemplated.

Golfers with particular dedication could enhance the benefit of the aid by consistently using the same two clubs with the device which clubs have coloured tape markings on the shaft at selected locations which can assist him/her with additional visual aid in locating the feet/ball for the particular practice club being used.

Turning to FIGS. 8–10, a more preferred embodiment of the invention is shown. Device 120 comprises plate 122 with central opening 124 for weight and material cost advantages which will be apparent to those skilled in the art. Device 120 has clip assemblies 126, 128, 130 and 132 with each of the assemblies including diametrically spaced but aligned portions. The essence of the construction of clip assemblies 126, 128, 130 and 132 is the same as the clip elements 14 and 18 of the embodiment in FIGS. 1–5 previously set forth. Clips 126, 128, 130, 132 are adapted to accept and be secured to the shaft portions of golf clubs. Clip assemblies 126 and 128 are on the same face 134 of plate 122 but are oriented at 30° to each other as shown by arc "C" in FIGS. 8 and 9. Clips 126, 128 are basically identically constructed as those 14 and 18 in the first embodiment but slots 140 are cut into the walls of the clip assemblies 126, 128 to enhance the flexibility of the clip assemblies, when they have a uniform diameter bore to accommodate the taper of the golf shaft more readily.

No further description of clips 126, 128 is believed to be necessary.

Turning to clip assemblies 130, 132 on face 136, the construction of these clips is similar to clips 126, 128 and those 14, 18 of the first embodiment. However the diametric size of clip assembly 132 is smaller than that of clip assemblies 126, 128 and 130 and it will also be noted that clip assemblies 130 and 132 share a common wall, wall 142, although this is not necessary.

Clips 126, 128 and 130 are sized and shaped to securely hold a golf club shaft adjacent the grip of the club in a manner similar to clips 14 and 18 of the FIGS. 1–5 embodiment.

Clip 132 however is sized smaller because it is intended to be secured to the smaller tapered portion of a golf shaft closer to the hosal of the shaft, as will become more evident from further description herein.

Turning to FIGS. 11 to 14, each made up of parts a, b and c, there is shown in parts a and b, a golfer addressing a ball 160, (FIG. 11) and different positions, (FIGS. 12–14), during a swing. More particularly, FIGS. 11*a* and *b* show golfer 162 addressing ball 160 and an assembly of clubs 164, 166 and 168 lying on the ground interconnected by two devices 120 and 172. Clubs 164 and 166 form the cross assembly with device 120 in accordance with the embodiment shown and used in FIGS. 1–7, club 164 being secured in clip assembly 128 on one side of plate 122 and club 166 being secured in clip assembly 130 on the other side of plate 122 and therefore at right angles to club 164. (See also FIG. 15). The second device 172, identical to device 120, is secured to the shaft of club 166 but closer to the hosal portion of the club through clip assembly 132, the smaller of the clip assemblies on face or side 136 of plate 172. Third club 168 is secured in clip assembly 126 of the second device 172 and therefore assumes a 30° angle with respect to club 166 as shown by arc arrow D, (FIG. 15).

One of the leading and most respected golf teachers is David Leadbetter and his book entitled "The Golf Swing" published by The Stephen Greene Press is one of the leading books on the golf swing, including positioning, stance and the swing itself.

Figure 11C:
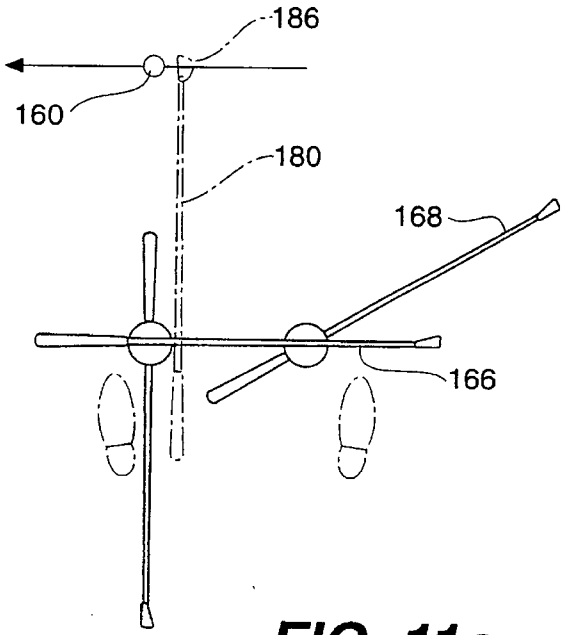
Figure 11B:
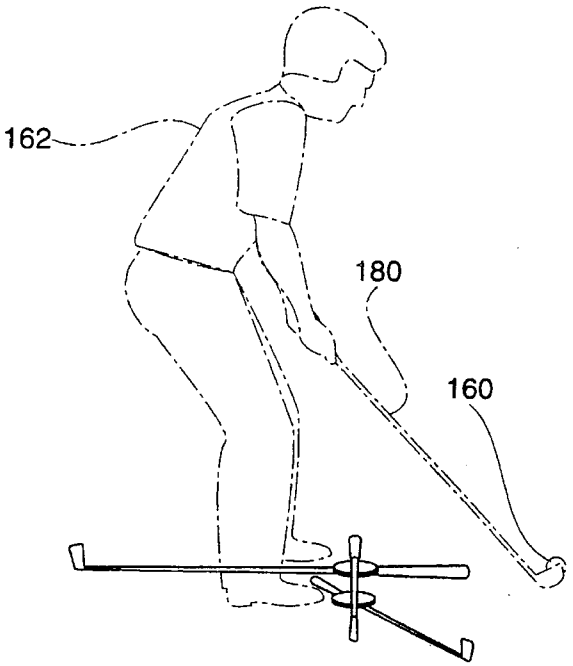
Figure 11A:
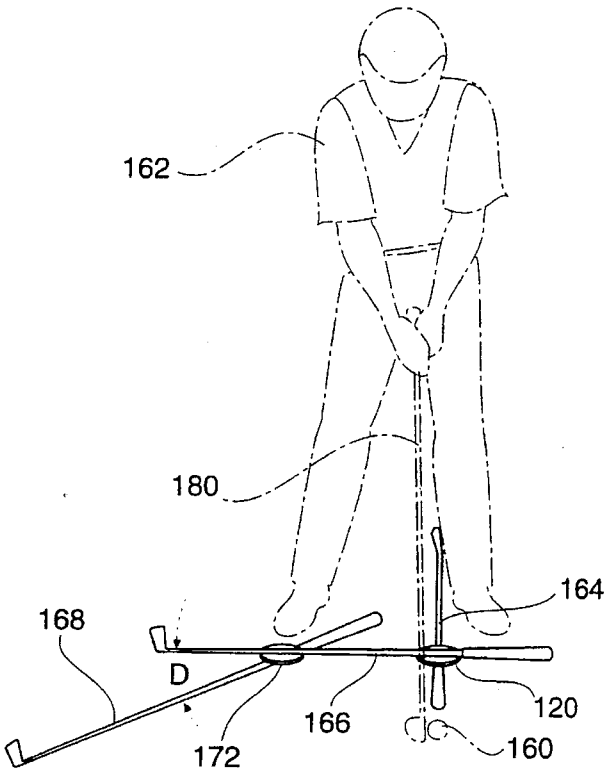

A golfer 162, using the inventive devices 120/172 in assembly with clubs, assumes an appropriate stance with club 180 as shown in FIG. 11*a, b, c*, in addressing ball 160. Clubs 164, 166 set the grid for helping the golfer to select his/her stance in relation to the direction of flight of the ball 160. This is along the lines of FIG. 7.

Figure 12C:
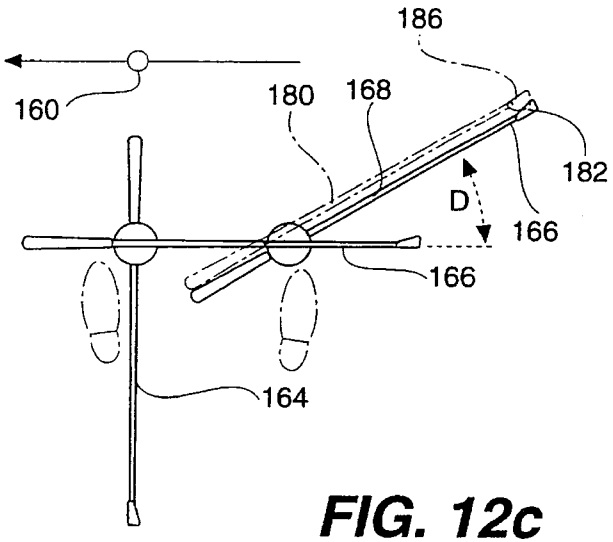
Figure 12B:
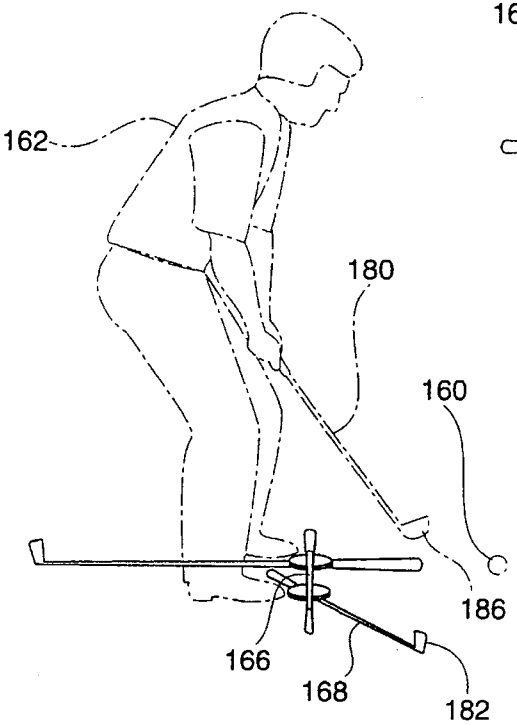
Figure 12A:
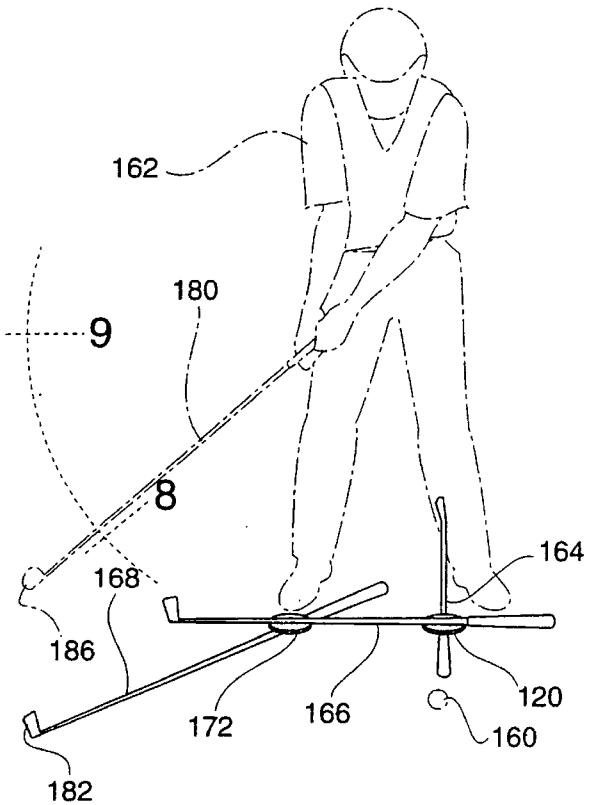

Leadbetter teaches that a golfer begins his swing, i.e. "taking the club away" by rotating the body so club 180 assumes an eight o'clock, (8:00 o'clock), position as shown in FIG. 12*a*. (FIG. 12*b* shows a view from the side and 12*c* schematically from overhead. This is the first check point in the swing. The club hands, arms and body move in unison away from the ball. There is no independent hand or arm movement relative to the torso, only rotation of the body. When a golfer assumes this technique and club 180 is at the 8:00 o'clock position, as shown in FIG. 12*a*, club 180 is directly above and in a substantially vertical plane parallel to that of club 168. (See FIG. 12*c*). Because of the friction of clip assembly 126 in securement of club 168, it is possible and desirable to have the head 182 of club 168 point upwardly. The head 186 of club 180 in the golfer's hands points upwardly in the same manner thereby permitting the golfer to visually see that his club has not been rotated by the hands when the swing assumes the 8:00 o'clock position.

Accordingly, the line and direction of club 168 and its head 182 provide the golfer with easy visual association and the attendant feel of club 180 in his/her hands relative to the check point at the "8:00 o'clock" position taught by Leadbetter.

The golfer is therefore able to not only have the assembly of clubs on the ground provide a grid for stance, (feet position), with respect to the ball and the selected line of flight, but the golfer is also able to visualize the first link or check point movement in his/her golf swing, rotating the body, hands, arms in unison so the club 180 in his/her hands assumes a position substantially in line with club 168. In this position, the club 180 is above and in a line parallel to that of club 168 with the club heads 182 and 186 pointing in the same upward direction. By this visual alignment, the golfer sees and feels the "8:00 o'clock position".

Figure 13C:
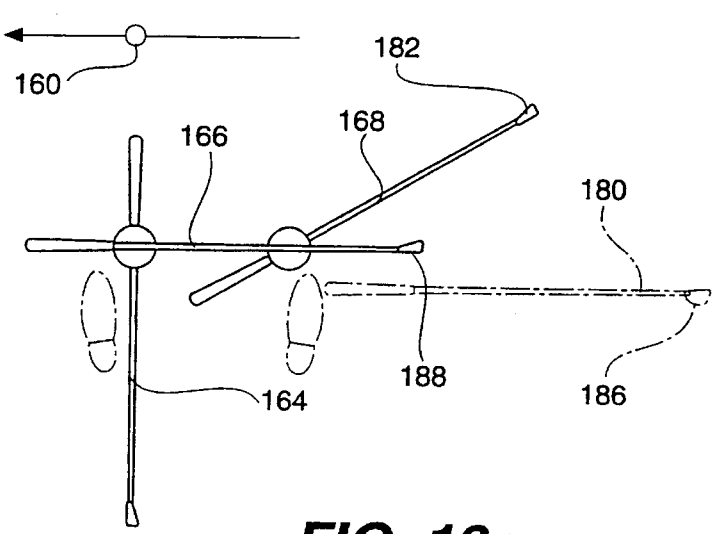
Figure 13B:
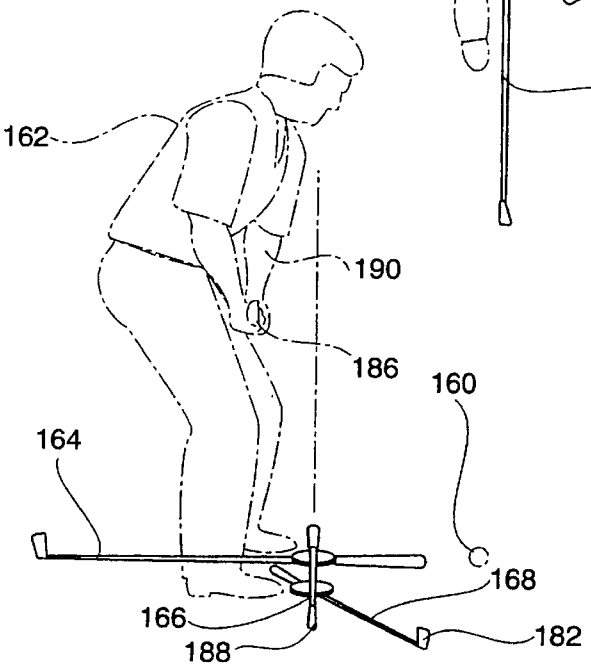
Figure 13A:
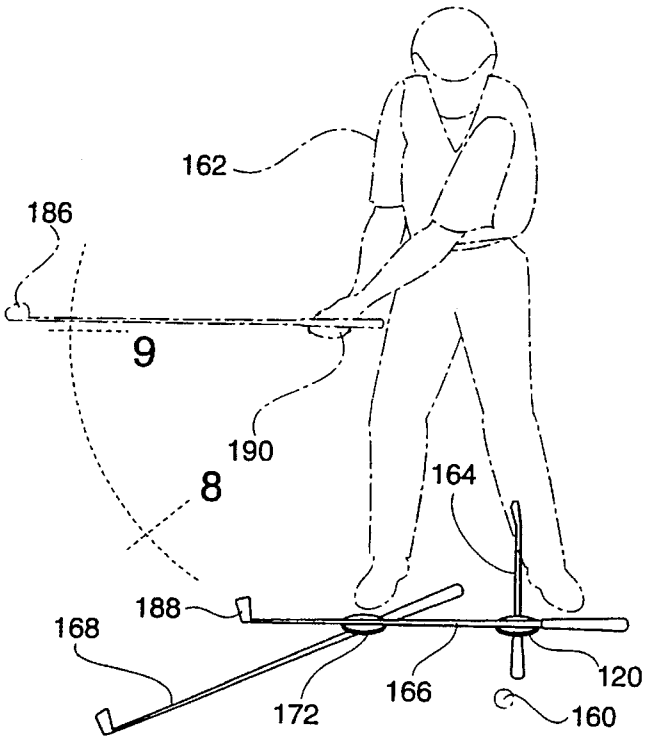

Moving on to FIGS. 13*a, b, c*, the golfer now has moved his hands 190 so the club is at the "9:00 o'clock" position based on the Leadbetter "clock". In this position, the club is parallel to the ground but it will also be noted that it is also parallel with club 166. With the club 166 secured in device 120, the head 188 can be directed upwardly and it will be noted that the head 186 of club 180 is also pointing vertically upward at the 9:00 o'clock position. The golfer's swing at the 9:00 o'clock position can therefore also be linked to the grid of clubs on the ground and the golfer has a visual aid to assist him/her in analyzing the swing and relating the "feel" of the swing to the Leadbetter "9:00 o'clock" position of the club. The repetition of this practice leads to developing consistency in the swing at this check point or position. Head 186 of club 180 also has a relationship with head 188 of club 166 and this further provides a visual check so that a feel relationship develops with the golfer enabling him to enhance duplication, repetition and consistency of swing.

Figures 14A, 14B, 14C:
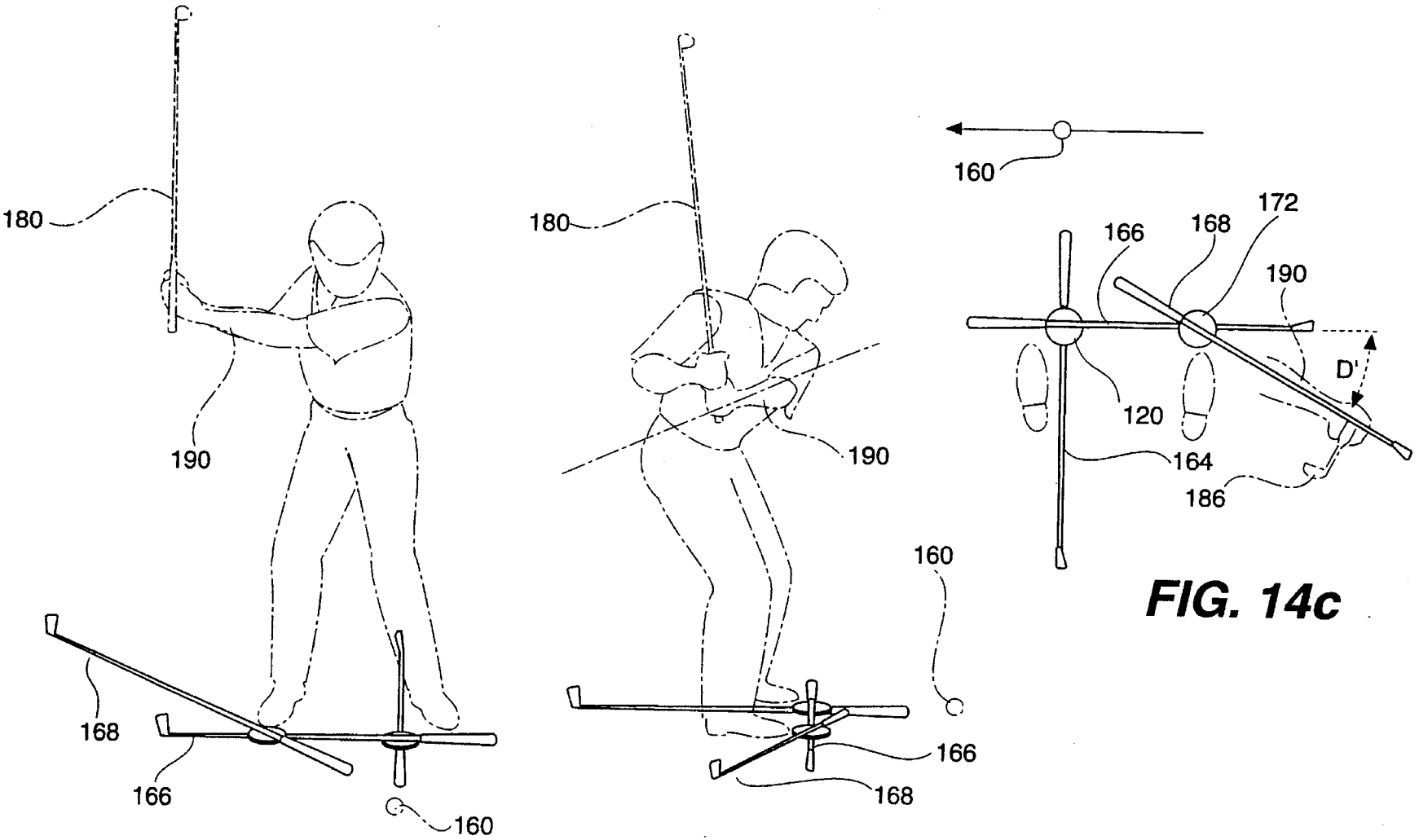

FIGS. 14*a, b, c* illustrate the next step or link in the swing wherein the arms, particularly left arm 190, come into play, the arms moving the club 180 so that it is basically perpendicular to the ground as seen in FIG. 14*a*. In this position, the left arm assumes a substantially horizontal position and angles rearwardly of the line of direction of club 166, as shown in FIG. 14*b*.

For the golfer who wishes to use a further visual aid for developing the feel of good swing fundamentals, club 168, as attached to device 172, can be rotated about club 166 and translated along the shaft of club 166, as desired, to assume a position shown in FIG. 14*a, b, c* (and FIG. 15 in phantom lines), in which case it angles rearwardly 30°, (D'), from the line of club 166. Although the perspective view tends to show a different angle, the left arm 190 assumes a position generally parallel and planar with the direction of club 180 providing further a guide for the golfer to appreciate the feel of this position of the swing with a visual aid.

Accordingly the golfer, with two devices, at least one of which would be structured along the line of that of FIG. 9, namely device 120 cannot only use these two devices in assembly with clubs in his/her bag to help develop consistency in the stance in relation to the desired line of flight of the ball, but can also use an assembly of clubs to provide a visual aid to link the three basic fundamental or check points in the golf swing. The use of a visual aid to help the golfer in learning the feel of the position of the hands, arms and club at each check point is a significant feature of the use of the inventive devices.

FIG. 15 illustrates an enlarged view of the devices 120 and 172 in association with clubs 164, 166 and 168, (phantom lines), relating to FIGS. 11–13. Further, FIG. 15 shows device 172, (in dotted lines), flipped over at 210 or assembled such that club 168 is directed rearwardly to achieve the alignment of clubs shown in FIG. 14. It will be appreciated that the clubs have been shown schematically in FIG. 15 in phantom lines and are not necessarily to scale relative to the devices 120 and 172.

A still further possibility in the use of the devices is for a golfer to use an assembly of clubs to assist in the specific alignment of the shot with respect to the flight of the ball. It will be appreciated that the ball 160 may be 18 inches, plus or minus, from the feet of the golfer or the club 166. Good golfers will often place two clubs on the ground, parallel with each other, one lined up for the direction of the desired flight of the ball 160 to the flag and the other parallel thereto, (e.g. club 166), for lining up the feet. In long shots, the difference between the alignment of the feet and that of the desired direction of the ball is not as significant as it is with short iron shots. In theory, if the feet are aligned with the flag, a perfect shot would place the flight of the ball on either side of the flag, depending on right or left handed golfer, the same distance as the ball was from the line of the feet. Accordingly, when practicing shots, particularly short iron shots, a desired approach is to align the desired flight of the ball with the flag. The line of the feet is then parallel to it. In order to assist the golfer in this aspect of his practice, a third device 200 may be used as shown in FIG. 15. Device 172 is connected with club 166 in clip assembly 132 and a club 202 is attached in clip assembly 128 so it is at right angles to club 166 and parallel to club 164.

The third device 200 is attached to club 202 through clip assembly 128 and a fourth club 204 is attached to clip assembly 130 of device 200.

Club 204 is parallel to club 166 and will remain so even if the assembly of clubs is moved on the ground. The lateral distance between clubs 166 and 204 can be adjusted so that club 204 is aligned with the desired direction of flight of the ball and the club 166 provides alignment for the feet.

The friction fit between the clip assemblies and respective shafts enables movement of the assembly on the ground by a foot or the club in the hands. The relative position of the clubs in the assembly is retained.

Figure 4:
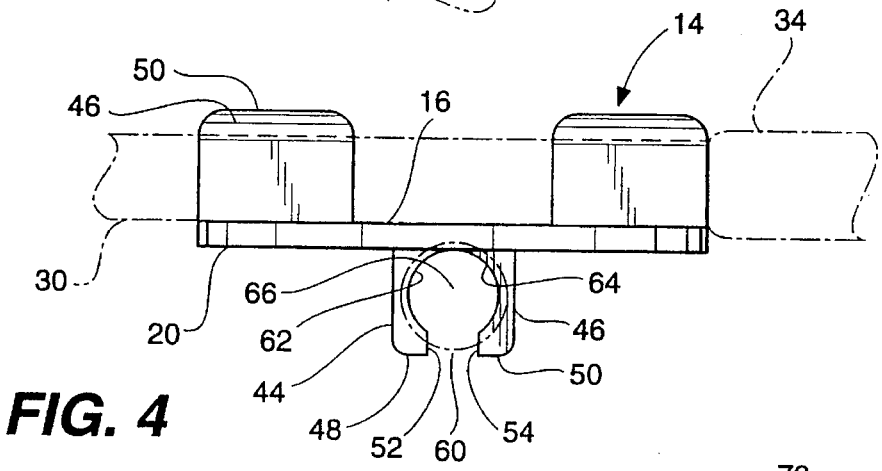
FIG. 4 is a front elevational view of the device as shown in FIG. 3.

In the embodiment of FIGS. 8–10, clip connector means 130 and 132 have been shown as separate, with clip connector means 130 being preferably adapted to securely grip a golf shaft adjacent the grip whereas connector means 132 is preferably adapted to securely grip a shaft distant from the grip that is along the shaft, closer to the club head. It will be obvious to persons skilled in the art that a single clip connector means could be used instead of the two 130, 132, provided the single clip means was flexible enough to firmly grip the golf club shaft at any location from the hosal end of the shaft to the grip end. Further, it will be apparent that a golfer could have a device such as shown in FIGS. 8–10 which has only connector means 130 and 126. This device would be used in combination with the device of FIGS. 3–5 to provide the assembly of clubs shown in FIGS. 11–14 or to simply provide the assembly of clubs 166 and 168 shown in these Figures. Still further, the assembly of clubs shown in FIG. 15 utilizing devices 122, 172 and 200 could be formed using three devices as shown in FIGS. 3–5 rather than one or more devices as shown in FIGS. 8–10. Nevertheless, the preferred device shown in FIGS. 8–10 enables easy mold manufacture of one device which, when combined with like devices, provides for the variation of assemblies noted herein. However, the scope of applicant's invention is intended to cover these possible modifications or variations.

Accordingly, it will be appreciated that I have provided a simple, relatively inexpensive device which can be easily carried by the golfer or provided by pro shops for use on practice ranges. Either alone or with other like devices and in assembly with clubs in the golfer's bag not otherwise being used, the golfer is provided with a stance and swing development aid.

The ability to see the desired check points in the swing and relate and develop the feel of the body, hands, arms and the club at each point, will help develop consistency in the swing of the practicing golfer, which every golfer strives for.

About 80% of the power in a golf swing is developed from a club position as shown in FIG. 14. Further, backward movement of the clubs may depend on the physical make-up of the golfer. Often golfers of smaller stature have more flexibility to extend the back swing to a higher position. Nevertheless, the major power of the golf swing is developed from the position shown in FIG. 14. A golfer practicing his/her game can develop significant power in simply developing a "grooved" consistent swing following the three check point positions noted above.

Finally, turning to FIG. 16, the finish of the golf swing is important and a further assembled embodiment of clubs using my device is shown.

FIG. 16 illustrates an assembly of clubs with devices 210, 212 and clubs 214, 216, 218 wherein the golfer can use club 218 to provide visual guidance of his right arm during the final stages of the swing, this being the opposite or result of the proper positioning of the left arm as shown in FIGS. 14*a, b, c*, such positioning creating the feel of the arms and hands following a circle.

Various other modifications and variations in the device will become apparent to those skilled in the art and I claim all such modifications and variations which fall within the appended claims.

The embodiments of the invention in which an exclusive property or privilege is claimed are defined as follows:

1. A device for use in combination with golf clubs to assist golfers in practicing appropriate aspects of a golf swing, said device comprising:

a plate having two opposed faces;

first connector means for detachable connection with a shaft of a first golf club on one face of said plate; and second connector means for detachable connection with a shaft of a second golf club on the opposed face of said plate, said first connector means and said second connector means each having respective axes, the axis of said second connector means being oriented so that it is at a predetermined angle to the axis of said first connector means.

2. The device of claim 1 wherein the predetermined angle is substantially 90°.

3. The device of claim 2 further comprising a third connector means for detachable connection with a shaft of a golf club, said third connector means being on said opposed face of said plate along with said second connector means and having an axis that is oriented at an acute angle to the axis of said first connector means, said third connector means being adapted to connect with a portion of a golf club.

4. The device of claim 3 wherein said third connector means is sized to firmly snap onto and grip a shaft of a golf club distant from the grip thereof.

5. The device of claim 4 wherein the flexible clip elements of at least one of said first, second and third connector means are split perpendicular to the axis of the elements whereby the flexibility of the clip elements; when being connected to a golf shaft, is enhanced.

6. The device of claim 2 further comprising third and fourth connector means for detachable connection with a shaft of a golf club, said third connector means being on said opposed face of said plate portion and having an axis that is oriented at an angle of substantially 30° to the axis of said first connector means and said fourth connector means being on said one face of said plate portion and having an axis parallel to the axis of said first connector means.

7. The device of claim 6 wherein said third connector means is sized to firmly snap onto and grip a shaft of a golf club distant from the grip thereof and wherein said fourth connector means is sized to grip onto a shaft of a golf club at least adjacent the grip thereof.

8. The device of claim 6 wherein said plate portion has a central aperture therein and each said connector means comprises at least two aligned flexible clip elements diametrically spaced across said plate portion.

9. The device of claim 8 wherein the flexible clip elements of said first, second and fourth connector means are split perpendicular to the axis of the respective elements, whereby the flexibility of the respective clip elements, when being connected to a golf shaft, is enhanced.

10. The device of claim 3 wherein said plate has a central aperture therein and each said connector means comprises at least two, aligned, flexible clip elements spaced diametrically across said plate.

11. The device of claim 1 wherein said first connector means comprises at least one elongate, U-shaped flexible clip means on said one face of said plate portion, said clip means having an outward opening slot and an annular bore for detachable connection with a golf club shaft.

12. The device of claim 11 wherein said elongate, U-shaped clip means comprises at least two aligned, spaced "U"-shaped flexible clip elements on said one face of said plate.

13. The device of claim 11 wherein the diameter of the bore in one selected U-shaped clip element varies from that in another aligned U-shaped clip element, whereby the diameters are varied in accordance with variations in taper of a golf club shaft.

14. The device of claim 11 wherein said clip means has a bore having a taper similar to the taper of a golf club shaft adjacent the grip thereof.

15. The device of claim 1 wherein said first connector means comprises at least one elongate clip means on said one face of said plate, said clip means being flexible and having a slot opening along the plane of said one plate face and having an annular bore for detachable connection with a golf club shaft.

16. The device of claim 15 wherein said clip means comprises at least two aligned, spaced "U"-shaped flexible clip elements on said one plate face.

17. The device of claim 15, wherein said second connector means for detachable connection to a club shaft is structurally, substantially identical to said first connector means and said predetermined angle is 90°.

18. The device of claim 1 wherein said selected angle is substantially 30°.

19. An assembly of golf clubs to assist a golfer in practicing appropriate stance and feet alignment with respect to aspects of a golf swing comprising at least two golf clubs detachably secured to a first support device, said first support device comprising a plate portion and at least two connector means, a first of said connector means being on one face of said plate portion and a second of said connector means being on the opposed face of said plate portion, the golf shaft of a first of said golf clubs being detachably secured to said plate portion by said first connector means and the golf shaft of a second of said golf clubs being detachably secured to said plate portion by said second connector means, the golf clubs being detachably connected to said plate portion at a predetermined angle to define first and second golf club axes.

20. The assembly of claim 19 wherein said predetermined angle is 90° and said clubs are at right angles to each other.

21. The assembly of claim 20 further including a second support device and a third club, said second support device having at least a first connector on one face of said plate which first connector means is substantially identical to the first connector means of said first support device, said second support device including a third connector means on said opposed face of said plate having an axis at substantially a 30° angle to the axis of said first connector means of said second device, said first connector means of said second device being connected to said second club shaft distant from said first device along said second club shaft and said third club being connected in said third connector means of said second device and at an angle of substantially 30° to the axes of said second club.

22. The assembly of claim 20 further including a second support device, a third support device and third and fourth golf clubs, said second and third support devices having first and second connector means substantially identical to the first and second connector means of said first support device, said first connector means of said second device being connected with the shaft of such second club and said third club being connected to the second connector means of the second device substantially at right angles to said second club, the first connector means of said third support device being connected with the shaft of said third club and said fourth club being connected to the second connector means of said third device substantially at right angles to said third club, whereby said first and third clubs are substantially parallel to each other and said second and fourth clubs are substantially parallel to each other, the lateral distance between the second and fourth clubs being selectively adjustable.

* * * * *